US006140267A

United States Patent [19]

Gundjian

[11] Patent Number: 6,140,267

[45] **Date of Patent: *Oct. 31, 2000**

[54] LASER PRINTING METHOD AND SUBSTRATE

[75] Inventor: Arshavir Gundjian, Montreal, Canada

[73] Assignee: Nocopi Technologies, Inc., West Conshohocken, Pa.

[ * ] Notice: This patent is subject to a terminal disclaimer.

[21] Appl. No.: 09/317,315

[22] Filed: May 24, 1999

Related U.S. Application Data

[63] Continuation of application No. 08/928,885, Sep. 12, 1997, Pat. No. 6,013,601.

[51] Int. Cl.[7] ..... B41M 5/30

[52] U.S. Cl. ..... 503/201; 428/690; 430/945

[58] Field of Search ..... 427/150–152; 430/945; 503/201, 204, 226

[56] References Cited

U.S. PATENT DOCUMENTS 5,750,462 5/1998 Gundjian ..... 503/201

*Primary Examiner*—Bruce H. Hess
*Attorney, Agent, or Firm*—Chadbourne & Parke LLP

[57] ABSTRACT

A method and substrate for printing information wherein at least one coating is applied to a substrate, the coating having a colorformer leucodye and at least one color activator. The colorformer leucodye and at least one activator react when heated to exhibit a chromic change of at least one of a color change visible in normal light and a fluorescence visible only in ultraviolet light. The at least one coating is heated with at least one laser beam to effect the chromic change at selected points to thereby print information.

4 Claims, 3 Drawing Sheets

LASER PRINTING METHOD AND SUBSTRATE

This application is a Continuation of application Ser. No. 08/928,885 filed Sep. 12, 1997, now U.S. Pat. No. 6,013,601.

BACKGROUND OF THE INVENTION

The present invention relates to a multifunctional coating technology that allows one to utilize a laser for printing such that the print can be designed to be either authenticatably eye visible or only fluorescently visible or totally invisible. This printing method uses a medium to high power density laser beam as the means for printing on a properly treated printing substrate.

The search for new methods of printing information and, more particularly, printing variable information goes on continuously. Recently the need to associate security features to methods of printing has gained a substantial importance, particularly as a result of the increasing concern that the business world is developing towards the monetary damages suffered from counterfeiting and grey marketing activities.

Having the above in mind, this invention provides a technology which renders direct printing integrating security features possible using a medium power laser beam typically of a few watts on a wide variety of substrates, provided the latter are coated using the coating scheme prescribed in this disclosure. The printing method and technology disclosed below becomes even more interesting in view of the possibility, well known in the trade, to control a laser beam direction and intensity in such a way that depending on the need the printed information may be a fixed and repetitive information or a variable information. Note that laser beams are currently already in use to inscribe variable information on paper or other substrates using other methods and technologies. For example, in the one well known case of desktop laser printers that have now become common office printing equipment, a low power laser beam of typically a fraction of a watt power installed in the printer is directed through appropriate controls to impart the desired information on to a photo-conductive surface in a way similar to the formation of a photo-image on the drum of a photocopier. The photoelectric image thus obtained is then transferred through a toner to the paper substrate that is originally placed in the tray of the laser printer. A second large class and already well known method of marking or information transfer to a substrate utilizing a laser is that wherein a medium to high power laser beam of several watts to kilowatts power is used. In this case the laser beam is directed to hit the substrate surface, the power is to be sufficiently high to cause the ablation of more or less minute quantities of the substrate surface material, thus leaving a visible trace. It is clear that a visible image will be left on the surface when the laser beam is controlled to hit the surface only at the spots which cumulatively constitute the desired final image. Such a control can be obtained either by using a high power laser beam of a few square centimeters cross sectional area that hits a mask where the desired image has been punched through, or with a single or multiple focussed set of beams of typically a few watts power where the single or multiple beams are controllably deflected in order to scan the surface of the substrate, to trace upon it the desired image, while simultaneously causing an ablation of the surface material by local melting and/or evaporation, the end result being obviously the formation of a visible image.

The above two well known laser printing methods have certain obvious limitations, such as in the first case, the printed surface is constrained to be essentially that of a printable grade fine paper sheet that can be fed into the printer; in the second case, the emanation of fumes or printing wastes that have to be continuously exhausted is a major concern. Finally and most importantly, the above laser printing methods do not lend themselves to date to the introduction of any security printing elements to the otherwise ordinary printing results.

SUMMARY OF THE INVENTION

The present invention is a method and technology of printing with a laser which can utilize a medium to high power laser beam, such as described above; it includes a coating method and technology that will be applied to the surface of the substrate to be printed. The use of this method and technology allows the laser beam to produce a fixed or variable image on the substrate without any mechanical action, such as scratching, evaporation or any other form of ablation of physical material. Furthermore, the disclosed method and technology not only allows to print on a substrate an eye invisible image, but it also allows to impart to the printed image one or more security printing features, by making it possible to authenticate the print as having been produced by a legitimate printing party. This method also makes possible to print with the laser a fluorescent image which becomes visible only when the print is exposed to an ultraviolet light source. Moreover, this method makes it even possible to print with the laser in an entirely invisible way to the eye under regular illumination or exposure to ultraviolet light. The introduction of many other variations of security printing features will become clear to anyone knowledgeable in this field given the information disclosed hereinafter.

These and other features and advantages of the present invention are achieved in accordance with the present invention as described hereinafter with reference to the attached drawings and the detailed description of the invention.

DETAILED DESCRIPTION OF THE INVENTION

The coating system according to the invention comprises coating inks. The coating ink system is chosen according to the preferred method of printing to be utilized with respect to a given substrate. Typically a flexo printing system can be used in many instances, however, in other cases, an offset printing ink base or even a spraying method may be found to be a more convenient vehicle to coat the substrate with the basic ingredients that constitute the fundamental components to be inserted in any of the above-mentioned coating vehicles.

The fundamental or critical components used in these coating inks belong to two families of chemicals A and B. The A components are chosen from the family of colorformer leucodyes and the B components are chosen from the family of activators, such as phenolic activator resins and many others which are well known typically used in the carbonless paper technology. The coating inks that are utilized in this laser printing scheme may contain one only of the A or B type components or several different A components or even both A and B type components together. In this latter case, the printing medium is chosen to be such that at least either one and preferably both A and B components are not soluble in the ink base vehicle.

Figure 1:
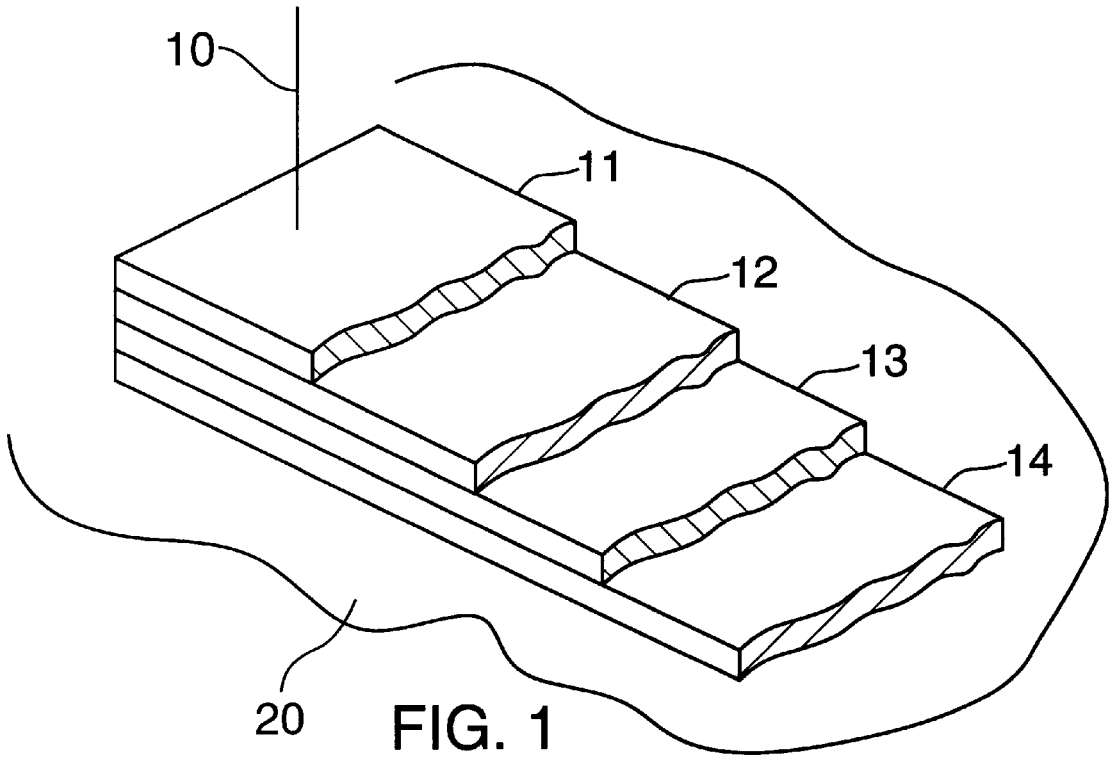
FIG. 1 is a partial cutaway view of a substrate according to the present invention for use with the method according to the present invention.

In general, the coating scheme to be applied on the substrate prepared for the security laser printing process has a multilayer structure as shown in FIG. 1. The bottom layer 20 can be paper, cardboard, plastic, mylar, metal, wood, or any material upon which traditional printing methods are used. Layers 12, 13 and 14 are selected from colorformer components A, activators B and different colors and layer 11 is a protective top coating, as will be described hereinafter.

Figure 2:
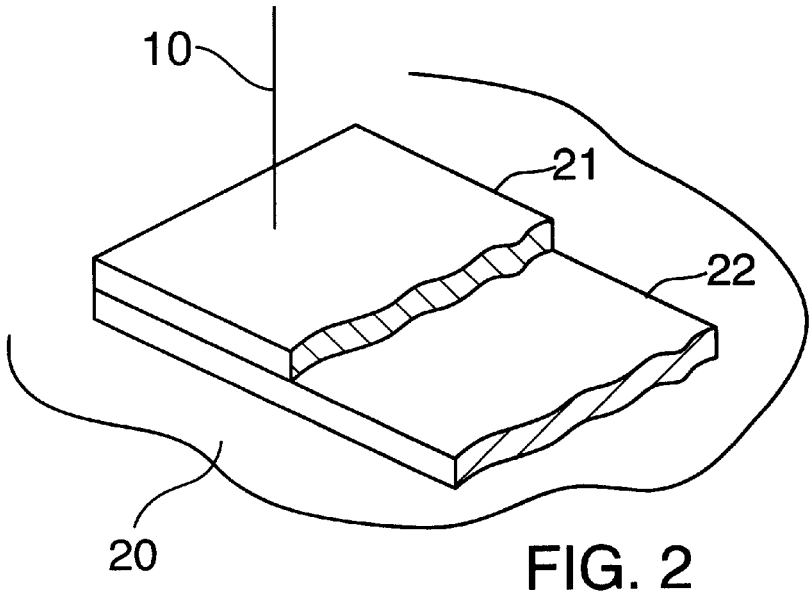
FIG. 2 is a partial cutaway view of a substrate according to a second embodiment of the invention.

FIG. 2 includes a double layer structure on a base layer 20, where layer 21 is obtained with a coating ink that contains one particular component B and the layer 22 is obtained with another essentially colorizing coating ink that contains generally more than one colorformer component Aα of which at least one colorformer is chosen to provide upon activation a visible distinct color, such as, blue, black, green, red, etc. and one other component Aβ at least is chosen from among colorformer leucodyes that we found will fluoresce when caused to activate by interacting with an activator B of the layer 21.

An example of Aα are the Hilton Davis leucodyes CK4 which comprises the color former $C_{31}H_{28}N_2O_3$ 6'-(dimethylamino)-3'-methyl-2'-(phenylamino) spiro (isobenzofuran-1(3H), 9'-(9H)xanthen)-3-one Examples of Aβ are the Hilton Davis leucodyes CK14 and in general amino phthalides and quinazolines, which comprises color former $C_{44}H_{56}N_2O_2$ 3-(4-dimethylamino)phenyl-3-(di(4-octyl)phenylamino) 1-(3H)-isobenzofuranone.

Examples of B are novalac resins, bisphenols and hydroxybenzoates, specifically the activator 4-hydroxy-4'-isopropoxy-diphenyl sulfone.

With the substrate coated with a coating system shown in FIG. 2, when the powerful scribing laser beam 10 hits this surface at a spot, it causes the temperature to rise. The power density of the laser beam and the exposure time are adjusted in such a way that the local temperature is raised to above 60° C. but well below the temperature that would start to cause a permanent physical damage to the coating material, typically 100° C. It is known that the Aα, Aβ and the B components start to interact in the range of temperatures described above. Thus, if the coating layer 21 contains only the Aα component, the exposed spot will exhibit a chromic change and a visible color will appear. The color depends on the choice of the Aα components and can be blue, black, red or others. On the other hand, when the layer 21 also contains the Aβ component, the presence of Aβ components and their interaction with B, while contributing somewhat to the visible color produced, will mainly cause the substrate to generate a distinct fluorescence at that same spot which can be observed only when a UV light is switched on that spot.

It is thus clear that when the laser beam 10 scans the desired full image on the coating in FIG. 2, it will generate on the one hand a clearly visible image of a chosen color without generating any material ablation wastes, and on the other hand, the printed image will carry a fluorescent signature that can be used to authenticate this image relative to an image of the same color produced without the utilization of this scheme.

It can be easily seen that the concepts described in the embodiment of FIG. 2 can be implemented in a number of different forms of coating configurations, each one of which will present certain advantages relative to FIG. 2.

Figure 3:
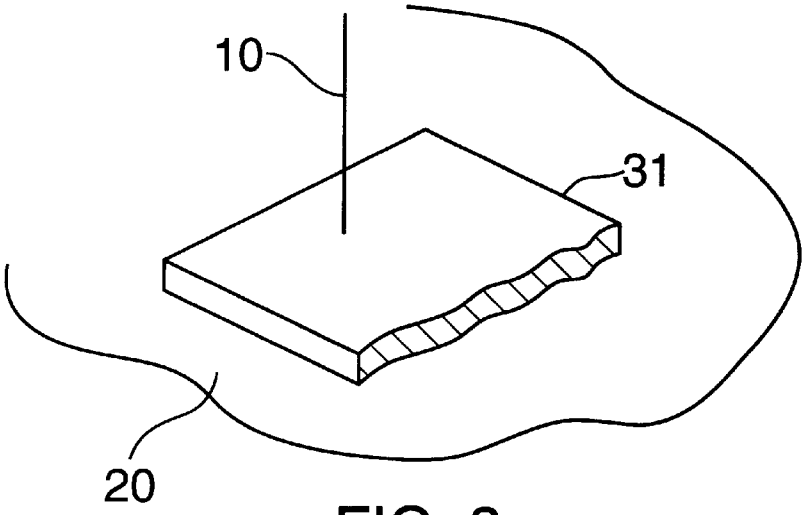
FIG. 3 is a partial cutaway view of a substrate according to a third embodiment of the invention.

The embodiment of FIG. 3 comprises a single layer coating 31 on base 20 obtained with a single coating ink that contains all of the three components Aα, Aβ and B. The advantage of this configuration is clearly the need for only one printing station. The coating ink vehicle in this case, however, must imperatively be inert with respect to all of the Aα, Aβ and B components, a good example for such a case is a water base flexo ink system. Clearly, an offset ink base that does not dissolve the active components A and B can also be used. It may be observed that the coating 31 may tend to show scratch marks as a result of rubbing of the printable surface, this can be avoided by the use of a top coat 11 of FIG. 1 described hereinafter.

Figure 4:
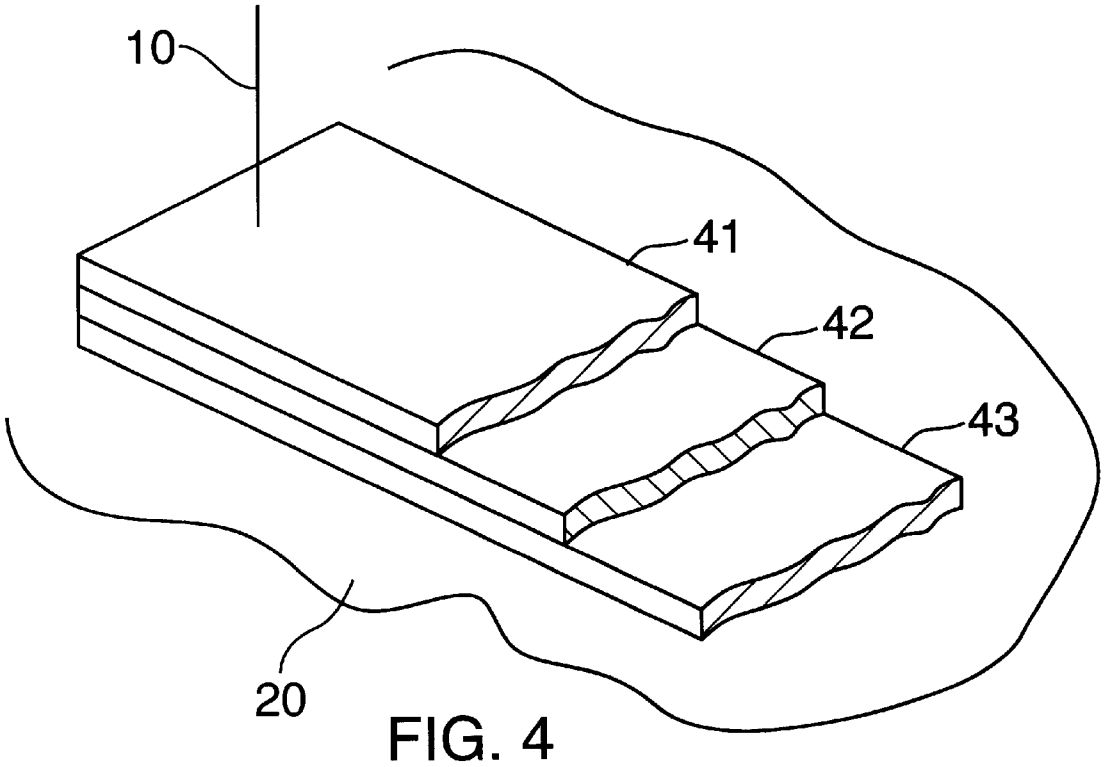
FIG. 4 is a partial cutaway view of a substrate according to a fourth embodiment of the invention.

The embodiment shown in FIG. 4 is a three layer coating obtained with the coating inks 41, 42 and 43. The coating ink 41 in this case contains only the Aβ components. The inks 42 and 43 contain respectively the Aα and the B components or inversely the B and the Aα components only. The advantage of this configuration is to render the fluorescent signature of the laser print very evident due to the isolation of the Aβ components at the top layer of the coating structure. The embodiment is applied in three coating ink printing stations. Clearly in this case, the visible color of the print is essentially determined with the combination of the layers 42 and 43.

We shall now describe a number of embodiments that will allow the laser printing of an image that can be invisible to the eye under normal lighting conditions but which will fluoresce when exposed to a UV light.

Figure 5:
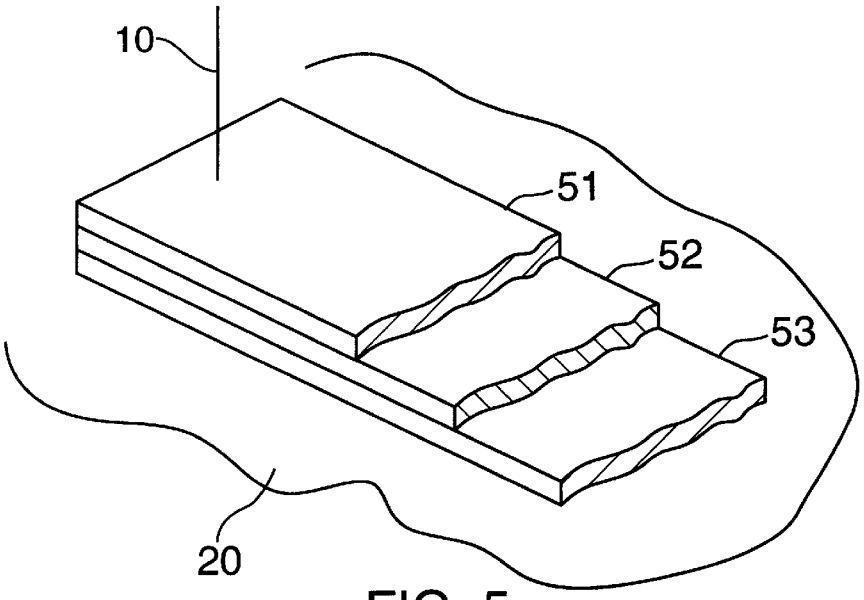
FIG. 5 is a partial cutaway view of a substrate according to a fifth embodiment of the invention.

The embodiment shown in FIG. 5 is a three layer coating system. Layer 51 is obtained with an ink containing the B component while layer 52 contains Aβ components only, and layer 53 is a layer that simply provides a background ordinary color which is made to be in the range of the color that the reaction of B and Aβ is likely to produce, or even better a much darker color such as blue, red or even black. When the laser beam 10 hits the substrate, the interaction of the B and Aβ components in layers 51 and 52 will produce a fluorescent color that may have a red, orange, yellow or green tint. It is clear that against the background color of the layer 53, no visible contrast will be visible in ordinary light. When, on the other hand, the image is exposed to a UV light, the fluorescence of the interacting layers 51 and 52 will stand out and render the image fluorescently visible.

Figure 6:
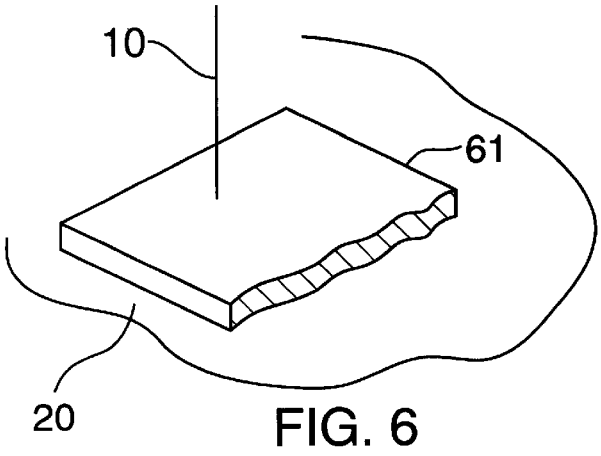
FIG. 6 is a partial cutaway view of a substrate according to a sixth embodiment of the invention.

The single layer embodiment of FIG. 6 is obtained by mixing all three ink components of FIG. 5 together in layer 61. Once more this requires an ink vehicle, such as a water base flexo ink system where no interaction takes place between the B, Aα and the color pigments of the layer 53 ink above, until the laser beam 10 raises the temperature of the spot where it hits to above the interaction temperature previously discussed. The advantage of this configuration is that it requires only one ink printing station. Again, because the coating is somewhat vulnerable to accidental mechanical rubbing or scratching with neighboring surfaces, a top coat 11 of FIG. 1 can be used to avoid this.

This laser image printing method and technology also allows one to print an image that is invisible to the eye under normal as well as UV illumination conditions.

Figure 7:
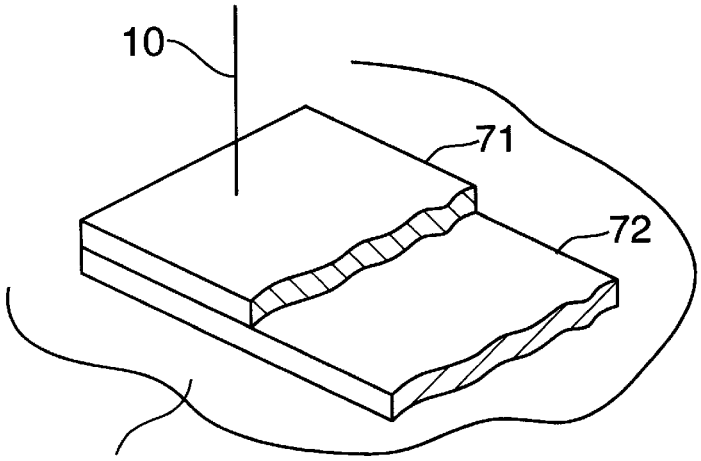
FIG. 7 is a partial cutaway view of a substrate according to a seventh embodiment of the invention.

Typically, an embodiment shown in FIG. 7 will provide the possibility to obtain such an invisible print.

The layer 71 in FIG. 7 is a dark colored layer printed with an ordinary ink providing such a color. A typical dark color could simply be black. One condition imposed on this color is that it be transparent to the far infrared wavelength of the laser beams utilized in the printing process. Since the lasers contemplated for use in the scribing applications herein are either a $CO_2$ laser with a 10.6 $\mu$ wavelength or a YAG laser with a 1.06 $\mu$ wavelength, both in the far infrared, a visibly black ink which is transparent to the above wavelength is easily obtained.

The layer 72 of FIG. 7 will be printed with an ink similar to the ink in the layer 31 in FIG. 3, except that this ink would contain only the components A$\alpha$ and B.

When the laser beam 10 hits the coating of FIG. 7, it will pass through the layer 71 and will interact with layer 72, thus producing an eye visible color spot on the layer 72. However, since the scanning laser beam 10 will thus generate this visible image under the screen provided by the dark colored layer 71, the visible image will be hidden to the viewer because of the presence of the masking layer 71. Thus, the printed image is inaccessible to the onlooker and it is revealed when the layer 71 is removed, for example, by simply scratching, scraping or by other means of mechanical removal.

It is clear that in any one or all of the above discussed embodiments, the chosen basic coating configuration can be topcoated with a protective top coating or lamination 11 of FIG. 1 provided that the latter is transparent to visible light and to the specific laser wavelength that is chosen to be utilized for scribing.

The coating configurations disclosed herein will clearly achieve the objectives of this invention, which consists of producing a set of coating inks for a given substrate which can then be printed on with medium to high power laser beams of typically the $Co_2$, 10.6 $\mu$ wavelength or the YAG 1.06 $\mu$ wavelength.

The inks according to the invention include the fundamental components A$\alpha$, A$\beta$ and B inserted in regular flexographic or offset ink vehicles, as well as in inert vehicles, such as, for example, water in a waterbase flexoink where the components are added in a micronized form.

It is understood that the embodiments described hereinabove are merely illustrative and are not intended to limit the scope of the invention. It is realized that various changes, alterations, rearrangements and modifications can be made by those skilled in the art without substantially departing from the spirit and scope of the present invention.

What is claimed is:

1. A method for printing information on a substrate comprising the steps of:

applying at least one layer to a substrate comprising a colorformer leucodye and a color activator, wherein the colorformer leucodye and the activator react when heated to exhibit a chromic change of a color change visible in normal light and a fluorescence visible only in ultraviolet light; and heating the at least one layer with at least one laser beam to effect the chromic change at selected points to thereby print information.

2. The method according to claim 1, wherein the step of heating comprises using a $CO_2$ 10.6 $\mu$ wavelength or a YAG 1.06 $\mu$ wavelength laser.

3. The method according to claim 1, wherein the heating is to a temperature above about 60° C. to below about 100° C.

4. The method according to claim 1, wherein the activator and at least one colorformer leucodye are in a micronized form.

* * * * *